US006679395B1

(12) United States Patent
Pfefferkorn et al.

(10) Patent No.: US 6,679,395 B1
(45) Date of Patent: Jan. 20, 2004

(54) VENTING CLOSURE

(75) Inventors: Georg Pfefferkorn, Mullheim (DE); Udo Bosl, Eimeldingen (DE)

(73) Assignee: Crown Cork & Seal Technologies Corporation, Philadelphia, PA (US)

( * ) Notice: Subject to any disclaimer, the term of this patent is extended or adjusted under 35 U.S.C. 154(b) by 0 days.

(21) Appl. No.: 09/763,310

(22) PCT Filed: Aug. 14, 1999

(86) PCT No.: PCT/EP99/05970

§ 371 (c)(1),
(2), (4) Date: Jun. 6, 2001

(87) PCT Pub. No.: WO00/10888

PCT Pub. Date: Mar. 2, 2000

(30) Foreign Application Priority Data

Aug. 22, 1998 (EP) ..... 98115875

(51) Int. Cl.[7] ..... B65D 51/06

(52) U.S. Cl. ..... 215/307; 215/341; 215/344; 215/343; 215/DIG. 1; 215/902; 215/252

(58) Field of Search ..... 215/252, 307, 215/902, 341, 343–345, DIG. 1, 354, 331; 220/367.1, 303, 203.01, 203.02, 203.19, 203.29, 203.11

(56) References Cited

U.S. PATENT DOCUMENTS

| | | | | | |
|---|---|---|---|---|---|
| 3,568,871 | A | * | 3/1971 | Livingstone | 215/344 |
| 4,276,989 | A | * | 7/1981 | Hicks | 215/344 |
| 5,133,471 | A | * | 7/1992 | Pujol Almirall | 215/252 |
| 5,292,020 | A | * | 3/1994 | Narin | 215/331 |
| 5,421,470 | A | * | 6/1995 | Dudzik | 215/343 |
| 5,803,286 | A | * | 9/1998 | Pfefferkorn et al. | 215/307 |
| 5,871,111 | A | * | 2/1999 | Pfefferkorn et al. | 215/307 |
| 6,021,912 | A | * | 2/2000 | Hertrampf | 215/344 |
| 6,338,414 | B1 | * | 1/2002 | Schellenbach | 215/252 |

FOREIGN PATENT DOCUMENTS

| | | |
|---|---|---|
| DE | WO 95 21095 | 8/1995 |
| DE | 196 13 830 | 5/1997 |
| EP | 464 384 A1 | 1/1992 |
| EP | 597 867 | 5/1994 |
| EP | 0 661 218 A1 | 7/1995 |
| GB | 2 013 635 A | 8/1979 |
| WO | WO 90/10981 | 9/1990 |

* cited by examiner

*Primary Examiner*—Robin A. Hylton
(74) *Attorney, Agent, or Firm*—Woodcock Washburn LLP

(57) ABSTRACT

A closure cap (1) with a cap base (2) and with a cap skirt (3) comprises an inner seal (4). The inner seal is provided with bleeding reliefs (11) which lift the sealing effect as soon as the cap base (2) is displaced axially upwards. The closure cap (1) comprises a first abutment and a second abutment (8). On screwing-on firstly the second abutment (8) comes into engagement with the container opening. By way of this a weakening zone (9) in the region of the cap base (3) is pretensioned to a predeterminable value. On account of the predeterminable pretensioning of the weakening zone (9) a bleeding at an exactly defined excess pressure is possible.

19 Claims, 2 Drawing Sheets

Figure 3:
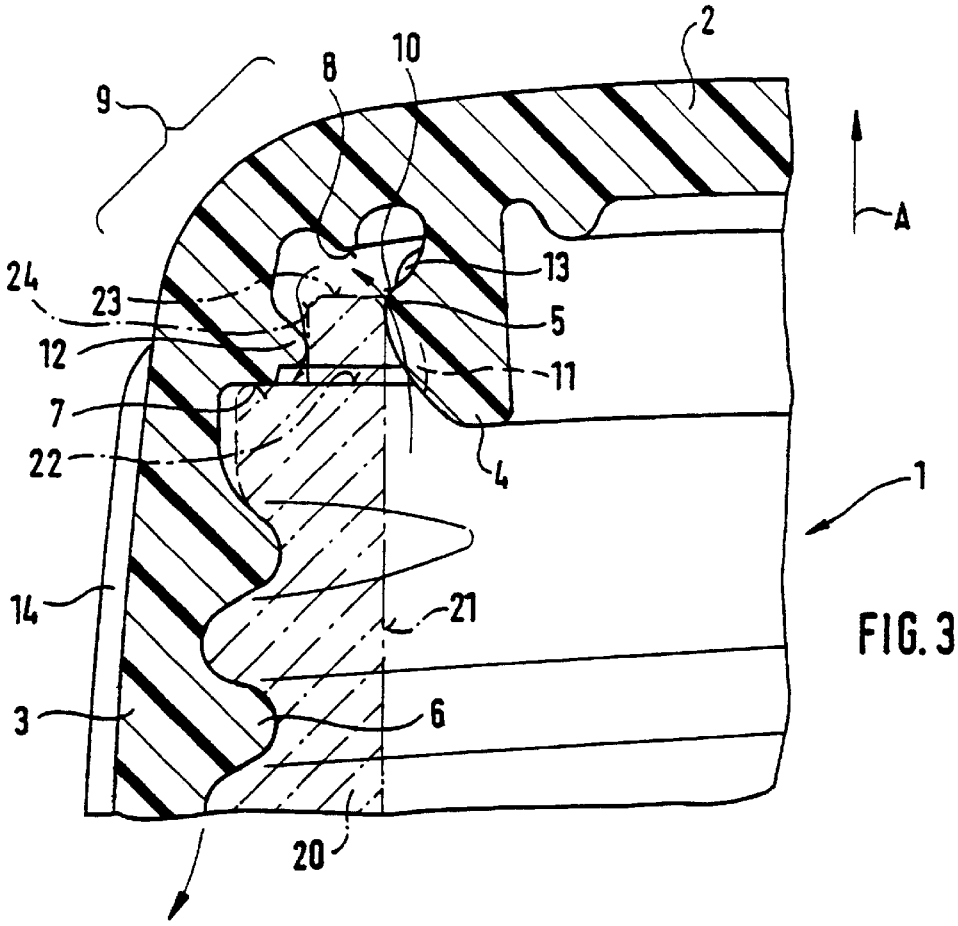

FIG. 1
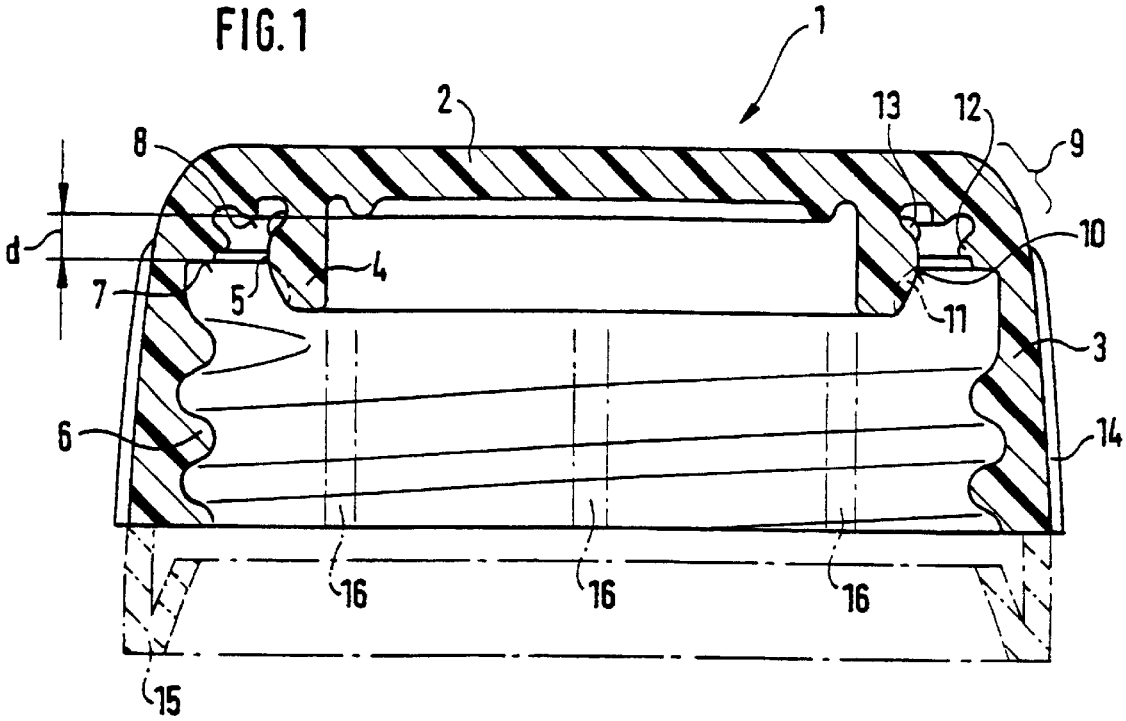
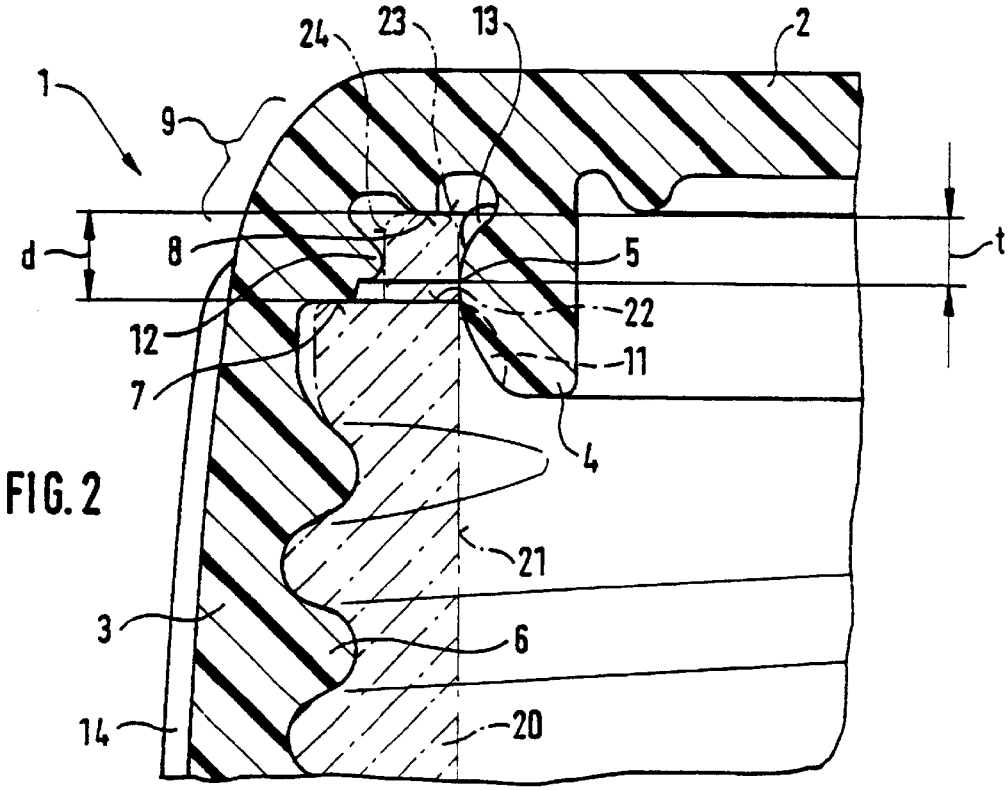
FIG. 2

VENTING CLOSURE

The invention relates to a closure cap with the features of the preamble of patent claim 1.

Closure caps of plastic material are applied in multitude for closing containers, for example drinks bottles.

In particular with carbon-dioxide containing drinks, but also with fruit juices, there exists the problem that the inner pressure in the container in the course of time may rise (by temperature increase or fermentation). Since closure caps usually should seal as good as possible in order to prevent leakages there exists the danger that the container on account of an increased inner pressure explodes. Above all with glass bottles exploding glass fragments represent a potential danger.

For solving this problem already various types of closure caps have been suggested.

From EP 597 867 it is for example known to provide a closure cap with a sealing inlay and simultaneously to define the screw on position of the closure cap. With an increased inner pressure the sealing disk is to be compressed, and with this act as a safety valve.

From EP 464 384 there is known a self-bleeding bottle closure with which by way of fluctuations in the head plate the sealing effect at an increased inner pressure is lifted.

From DE 196 13 830 there is known a self-bleeding closure in which the cap base is weakened. The weakening leads to the fact that with an increased inner pressure the cap base is curved outwards (so-called doming) and that with this an inner sealing formed as one piece with the cap base is relieved of pressure.

All these known solutions however have certain disadvantages. The degree of compression of an inlayed sealing disk can only be controlled with great difficulty. Furthermore the pressing of the sealing disk over the whole circumference of the container opening is homogeneous so that the exact control of the bleeding procedure is difficult.

With closure caps provided with weakenings in the head plate there exists the problem that an inner sealing, on account of the doming, is relieved of pressure, but that seals which seal at the upper opening edge and above all outside on the container opening, by way of this are not relieved of pressure.

It is the object of the invention to avoid the disadvantages of the known, in particular thus to provide a closure cap which with an optimal sealing under normal conditions permits a reliable and exactly controllable bleeding with an increased inner pressure in the container closed by the closure cap. The closure cap is to be simply and economically manufacturable and able to be screwed on with usual screw-on devices.

According to the invention these objects are achieved by a closure cap with the features of the characterising part of patent claim 1.

The closure cap consists essentially of a cap base and a cap wall. On the cap base there is provided an inner seal. The seal is provided with a seal line which can be pressed against the inner side of the container opening and with this achieves a sealing effect.

The closure cap may be retained on the container opening by retaining elements arranged on the inner side of the cap wall, for example by a screw thread.

The closure cap comprises a first abutment which rises roughly from the base.

According to the invention axially between the retaining elements and the first abutment there is arranged a second abutment for limiting the screwing-on movement of the closure cap. The second abutment may for example come into engagement with the beginning of a thread on the container opening and thus limit the screwing-on movement. The second abutment is advantageously formed as a circumferential ring whose abutment plane runs roughly perpendicular to the axis of the closure cap.

The cap wall is furthermore provided with a deformable wall section. The deformable wall section is arranged between the first and the second abutment. The deformability may be achieved by a weakening of the wall thickness in the region of the wall section, for example by way of a deepening on the inner side of the cap wall.

The inventors of the present invention have ascertained that a weakening of the closure cap in the region of the cap wall in contrast to known weakenings in the cap base has surprising advantages. An increased inner pressure in the container closed by the closure cap does not lead in the first case to a curving of the cap base, but to an axial displacement of the cap base. The movement is thus essentially linear. This means that any seals on the outer side or on the end-face side of the container opening on account of the axial translation movement of the cap base likewise come out of sealing engagement. Of course as previously a certain curvature may occur.

So that the closure cap bleeds at the correct point in time on the one hand the axial distance between the first and the second abutment, and on the other hand the penetration depth of the sealing line are selected in a manner such that the sealing line given a predetermined inner pressure comes out of engagement with the inner side of the container opening. This minimal pressure is different according to the material filled in the container. With fruit juices it is at about 2 bar, with low $CO_2$-containing drinks at 5 bar and with a content with 4 Vol. % $CO_2$ above 8 bar. The degree of deformability of the wall section is likewise correspondingly selected.

The first abutment on screwing-on comes into engagement with the upper side of the container opening before the second abutment comes into engagement with the beginning of the thread.

Therebetween the first abutment and the deformable wall region are deformed on account of the screwing-on movement.

The penetration depth of the sealing line defines the axial distance of the sealing line from the first abutment in the deformed condition or the distance of the sealing line to the upper side of the container opening.

By way of the directed choice of the distance between the abutments and the deformability of the wall section, the deformable wall section on screwing on the closure is pretensioned to a predetermined value in the manner of a spring.

By way of a suitable choice of the penetration depth of the sealing line the point in time of the bleeding may be predetermined. If the inner pressure is so large that the cap base is displaced against spring force by the penetration depth the closure bleeds.

The deformability is set for normal conditions, i.e. for temperatures in the region of 15–35°. If the outer temperature exceeds these values, the deformability becomes larger (softening of the plastic material). The bleeding function is therefore favoured at a higher temperature.

The two abutments serve the exact defined pretensioning of the weakening zone in the cap wall. With this an exactly predefined bleeding pressure may be set.

The inner seal comprises also advantageously bleeding reliefs on its side facing the cap skirt. The sealing reliefs are arranged below the sealing line. The inner seal is advantageously formed as a so-called olive seal. This means that the sealing line defines a maximum outer diameter of the inner seal and is arranged distanced to the inner side of the cap base. Such olive seals have the advantage of sealing in the inside of the container opening where normally there is to be found an exactly defined sealing surface without damage. The disadvantage of such olive seals is however that on acount of the pretensioning they already seal when the closure cap is not located in the placed-on condition, but axially slightly above the sealing position. Thanks to the bleeding reliefs which advantageously begin directly below the sealing line the sealing effect is lifted as soon as the sealing line lies outside of the container opening. An extension of the sealing effect on account of, the displacement of the sealing line over the inner seal which tapers conically downwards is thus prevented.

The closure cap may furthermore be provided with a circumferential sealing bulge which can be pressed against the outer side of the container opening. The sealing bulge is axially arranged between the first and second abutment.

The closure cap is furthermore advantageously provided with retaining-open elements. Such retaining-open elements may for example be provided above the sealing line on the surface of the inner seal, which faces the cap wall. The retaining-open elements prevent a displacement of the sealing line. If with an increased inner pressure is should however come to a doming of the cap base, the retaining-open elements are supported on the container opening so that the position of the inner seal with respect to the container opening is essentially only changed by translation. Retaining-open elements may of course also be provided on the remaining sealing elements, in particular on the second abutment acting as a seal or on the optional annular bulge pressing against the outer side of the container.

The invention is hereinafter described in more detail in embodiment examples and by way of the drawings.

Figure 4:
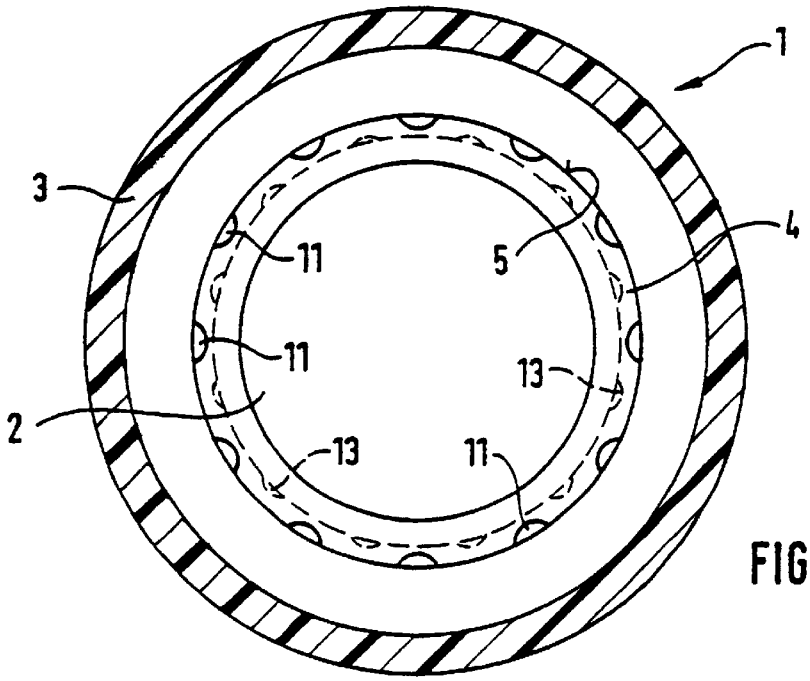

There are shown:

FIG. 1 a cross section through the closure cap according to the invention,

FIG. 2 an enlarged cutout of the sealing part of a closure cap on a container opening, FIG. 3 an enlarged representation of the sealing part of a closure on a container with an increased inner pressure and FIG. 4 a schematic representation of a lower view of a closure cap.

FIG. 1 shows a closure cap 1 which essentially consists of a cap base 2 and of a cap wall 3. The cap wall 2 is provided with a screw thread 6 with which the closure cap 1 can be screwed onto a container opening 20.

On the inner side of the cap base 2 there is arranged an inner seal 4 in the form of a circumferential sealing lip. The inner seal 4 is formed as a so-called olive seal. The inner seal comprises a sealing line 5 which can be pressed against the inner side of a container opening. The sealing line Sis arranged at a distance to the inner side of the cap base 2 and defines the maximum outer diameter of the surface 10 of the inner seal 4, which faces the cap skirt 3.

The inner seal 4 below the sealing line 5 is provided with bleeding reliefs 11 which are arranged on the surface.

On the inner side of the cap base 2 there is provided a first abutment 8. The first abutment 8 is formed as a circumferential bulge which simultaneously has a sealing function.

Above the end of the thread 6 there is arranged a second abutment 7 on the inner side of the cap wall 3 above the thread 6. The abutment 7 comprises an abutment plane which runs roughly perpendicular to the axis of the closure cap. The abutments 7, 8 are distanced in the axial direction by a predetermined distance d.

Between the first abutment 8 and the second abutment 7 the cap wall 3 is provided with a deformable wall region 9.

On the surface 10 of the inner seal 4 there are furthermore arranged retaining-open elements 13 which ensure that the sealing line 5 of the inner seal 4 does not displace, i.e. that the inner seal 4 only in the region of the sealing line 5 can sealingly bear on the inner side of the container opening.

The outer side of the cap skirt 3 is furthermore provided with a corrugation or with ribs 14 which give the cap wall 3 below the weakening zone 9 an adequate strength and good gripping characteristics.

The closure cap 1 may furthermore be provided with a guarantee strip 15 and with vertical bleeding slots 16 which interrupt the thread 6. Such guarantee strips and bleeding slots are known to the man skilled in the art.

In FIG. 2 the sealing part of the closure cap according to FIG. 1 is shown enlarged. If the closure cap 1 is screwed onto the container opening 20 the first abutment 8 comes into engagement with the end-face side 23 of the container opening 20. By further screwing, the cap wall 3 in the region of the deformable wall section 9 is axially deformed for so long until the second abutment 7 comes into engagement with the thread beginning 22 of the container opening 20. In the completely placed-on condition the deformable wall region 9 is therefore pretensioned to an exactly predetermined value.

Simultaneously a circumferential sealing bulge 12 seals against the outer side 24 of the container opening 20. On the inner side 21 of the container opening 20 there bears the inner seal 4 with the sealing line 5. The sealing line 5 has a penetration depth t predetermined by the relative position to the second abutment 7.

As soon as the inner pressure in the container closed by the closure cap 1 rises, the cap base 2 is displaced upwards in the axial direction A (see FIG. 3). The axial displacement of the cap base 2 is favoured by the deformable wall section 9. The second abutment 7 with this remains in engagement with the thread beginning 22 of the container opening 20. The first abutment 8 is lifted from the end-face side 23 of the container opening 20 and the inner seal 4 slides along the inner side 21 of the container opening 20 upwards in the arrow direction A so that the sealing line 5 comes out of engagement with the inner side 21. An increased inner pressure may therefore be compensated by the bleeding reliefs 11. Between the second abutment 7 and the thread beginning 27 on account of the thread pitch there is a sealing contact only on a short circumferential section. The reduction of the inner pressure is furthermore favoured by the bleeding slots 16 shown in FIG. 1.

By way of the axial displacement of the cap base 2 also the bulge 12 pressed against the outer side 24 of the container opening 20 is relieved of pressure so that a bleeding is possible.

The bleeding reliefs 11 are of a particular advantage because the inner seal 4 is introduced into the container opening unter pretension and the sealing line 5 is arranged deep in the container opening. On account of the bleeding reliefs 11 a bleeding occurs as soon as the sealing line 5 comes out of engagement with the inner surface 21 of the container opening. Without bleeding reliefs 11 on account of the pretension the surface 10 of the inner seal 4 also below the sealing line 5 would still remain in sealing engagement with the inner side 21 of the container opening 20 during the axial displacement.

The retaining-open element or elements 13 ensure a straight-lined displacement of the cap base 2 and prevent the inner sealing 4 from carrying out a tilting movement, i.e. from rolling off over the surface lying above the sealing line 5.

In FIG. 4 the closure cap 1 is schematically represented in the view from below. Threads, abutments and the outer-lying sealing bulge 12 have been omitted for simplification. The bleeding reliefs 11 and the retaining-open elements 13 are uniformly arranged over the circumference of the inner seal.

The core of the invention lies in forming the cap base 2 without weakenings so that a doming of the cap base, i.e. an outward curvature is made more difficult or is reduced. Instead of this a deformable wall section 9 is provided in the region of the cap wall 3. This weakening in the region of the cap wall 3 permits an axial movement of the cap base given an increased inner pressure. The representation shown in FIG. 3 has been carried out in an exaggerated manner to emphasise the gas evacuation procedure. In reality the cap base with an increased inner pressure only lifts by a small amount. As soon as the inner pressure becomes smaller the cap base 2 lowers again and the closure cap 1 seals again. It has been shown that with such arrangements the inner pressure in the containers over several weeks may be kept at an adequately low value. With this a multitude of bleeding procedures subsequently following one another are to be observed.

Essential to the degree of pretensioning of the weakening zone 9 is the distance d between the first abutment 7 and the second abutment 8 in comparison to the axial distance d between the upper edge of the thread beginning 22 and the end-face side 23 of the container opening 20. The distance between the abutments 7, 8 in the embodiment example is 1.3 to 1.5 mm. The distance between the upper edge of the thread beginning 22 and the end-face side 23 of the container opening 20 is 1.7 mm. The penetration depth t of the sealing line 5 is 0.8 to 1.0 mm according to the content of the container.

The bleeding reliefs 11 are arranged at a distance of 0.2 to 0.3 mm below the sealing line 5 on the surface of the inner seal 4. The bleeding reliefs 11 extend towards the lower end of the inner seal 4 at least over that part of the surface 10 of the inner seal 4 which on screwing the closure cap 1 on or off may be in engagement with the inner side 21 of the container opening.

What is claimed is:

1. A closure cap, comprising:

a cap base;

a cap wall having wall thickness, an inner side, and a deformable wall section;

a circumferential inner seal rising from the cap base, the inner seal having a sealing line which in a screwed on position of said closure cap is capable of being engaged with an inner side of a container opening;

retaining elements arranged on the cap wall, for retaining the closure cap on the container opening;

a first abutment rising from the cap base;

a second abutment axially arranged between the retaining elements and the first abutment, for limiting screwing-on movement;

wherein the deformable wall section is axially arranged between the first abutment and the second abutment, capable of at least linear displacement upon an exerted force; and wherein a distance between the first abutment and the second abutment, a penetration depth of the sealing line, and a degree of deformability of the deformable wall section are selected in a manner such that the sealing line at a predeterminable inner pressure is capable of being brought out of sealing engagement with the inner side of the container opening.

2. A closure cap according to claim 1, wherein the first abutment and the second abutment are arranged in a manner such that the second abutment is capable of being engaged with a thread beginning on the container opening after the first abutment is capable of being engaged with an end-face side of the container opening.

3. A closure cap according to claim 1, wherein the inner seal comprises at least one bleeding relief on its surface facing the cap wall and arranged below the sealing line.

4. A closure cap according to claim 3, wherein the at least one bleeding relief begins directly below the sealing line and extends towards an end of the inner seal.

5. A closure cap according to claim 1, wherein the closure cap further comprises a circumferential bulge which is axially arranged between the first abutment and the second abutment, and which is capable of being pressed against an outer side of the container opening.

6. A closure cap according to claim 1, wherein a surface of the inner seal which faces the cap wall, comprises at least one retaining-open element which is axially arranged above the sealing line.

7. A closure cap according to claim 1, wherein the deformable wall section is formed by a weakening of the wall thickness.

8. A closure cap according to claim 7, wherein said weakening of the wall thickness is a deepening on the inner side of the cap wall.

9. A packaging, comprising:

a container having an opening, comprising an end-face side and a thread disposed thereon, the thread having a beginning; and a closure cap comprising:

(i) a cap base;

(ii) a cap wall having wall thickness, an inner side, and a deformable wall section;

(iii) a circumferential inner seal rising from the cap base, the inner seal having a sealing line which in a screwed on position of said closure cap is capable of being brought into engagement with an inner side of a container opening;

(iv) retaining elements arranged on the cap wall, for retaining the closure cap on the container opening;

(v) a first abutment rising from the cap base, and (vi) a second abutment rising from the cap wall and axially arranged between the retaining elements and the first abutment, for limiting screwing-on movement;

wherein the deformable wall section is axially arranged between the first abutment and the second abutment, capable of at least linear displacement upon an exerted force;

wherein the first abutment is capable of being engaged with the end-face side, the second abutment is capable of being engaged with the thread beginning, and wherein a first axial distance between the end-face side and the thread beginning is larger than a second axial distance between the first abutment and the second abutment.

10. A closure cap, comprising:

a cap base and a cap skirt extending therefrom;

an inner seal extending from said cap base and radially inward from said cap skirt, said inner seal having an outwardly directed sealing line;

a first abutment extending from said cap base and interposed between said cap skirt and said inner seal;

a second abutment extending from an inner wall of said cap skirt and distal to said first abutment; and a deformable wall section of said cap skirt and said cap base interposed between said first abutment and said second abutment, capable of at least linear displacement upon an exerted force;

wherein an axial distance between said first abutment and said second abutment provides for engagement of said first abutment with an end surface of a neck of a container prior to engagement of said second abutment with a screw thread of said container.

11. A closure cap according to claim 10, wherein a distance between said first abutment and said second abutment provides for engagement of said first abutment with a container prior to said second abutment engagement with said container.

12. A closure cap according to claim 10, wherein the distance is from about 1.3 to about 1.5 mm.

13. A closure cap according to claim 10, wherein said inner seal comprises at least one bleeding relief.

14. A closure cap according to claim 13, wherein said bleeding relief is distal to said sealing line.

15. A closure cap according to claim 10, further comprising a sealing bulge extending from said cap skirt interposed between said first abutment and said second abutment.

16. A closure cap according to claim 10, wherein said inner seal comprises at least one retaining-open element extending outwardly therefrom and proximate to said cap base.

17. A closure cap according to claim 10, wherein said deformable wall section comprises less material than surrounding wall sections.

18. A package, comprising:

a container having an opening comprising a circumferentially arranged thread, said thread having a beginning, and said opening further comprising an end-face side distal to said thread beginning; and a closure cap, comprising:

(i) a cap base and a cap skirt extending therefrom;

(ii) an inner seal extending from said cap base and radially inward from said cap skirt, the inner seal having an outwardly directed sealing line;

(iii) a first abutment extending from said cap base and interposed between said cap skirt and said inner seal;

(iv) a second abutment extending from an inner wall of said cap skirt and distal to said first abutment; and (v) a deformable wall section of said cap skirt and said cap base interposed between said first abutment and said second abutment, capable of at least linear displacement upon an exerted force, wherein said first abutment is engaged with said end-face side, said second abutment is engaged with the remaining portion of said thread beginning, and wherein the first axial distance between the end-face side and said thread beginning is greater than a second axial distance between said first abutment and said second abutment.

19. A package according to claim 18, where in the first axial distance is from about 1.3 to about 1.5 millimeters, and the second axial distance is at least about 1.7 millimeters.

* * * * *